US007701436B2

(12) United States Patent
Miyasaka

(10) Patent No.: US 7,701,436 B2
(45) Date of Patent: Apr. 20, 2010

(54) ELECTROPHORETIC DEVICE, ELECTRONIC APPARATUS, AND METHOD FOR DRIVING THE ELECTROPHORETIC DEVICE

(75) Inventor: Mitsutoshi Miyasaka, Suwa (JP)

(73) Assignee: Seiko Epson Corporation (JP)

( * ) Notice: Subject to any disclaimer, the term of this patent is extended or adjusted under 35 U.S.C. 154(b) by 1168 days.

(21) Appl. No.: 11/289,574

(22) Filed: Nov. 30, 2005

(65) Prior Publication Data

US 2006/0139309 A1 Jun. 29, 2006

(30) Foreign Application Priority Data

Dec. 28, 2004 (JP) ..... 2004-381485

(51) Int. Cl.
*G09G 3/34* (2006.01)

(52) U.S. Cl. ..... 345/107; 345/84

(58) Field of Classification Search ..... 345/87, 345/107, 204, 211, 690, 90, 92, 98, 34, 58, 345/84, 206, 212, 214; 359/296, 267; 349/33, 349/48

See application file for complete search history.

(56) References Cited

U.S. PATENT DOCUMENTS 5,490,000 A * 2/1996 Tanaka et al. ..... 349/33
5,648,794 A * 7/1997 Jelsma et al. ..... 345/98
5,691,783 A * 11/1997 Numao et al. ..... 349/48
6,650,462 B2 * 11/2003 Katase ..... 359/296
6,762,744 B2 * 7/2004 Katase ..... 345/107
6,961,047 B2 * 11/2005 Katase ..... 345/107
6,980,184 B1 * 12/2005 Stewart et al. ..... 345/87
7,019,889 B2 * 3/2006 Katase ..... 359/296
7,145,547 B2 * 12/2006 Johnson ..... 345/107
2002/0005832 A1 * 1/2002 Katase ..... 345/107
2002/0021483 A1 * 2/2002 Katase ..... 359/267
2004/0051935 A1 * 3/2004 Katase ..... 359/296
2004/0212870 A1 * 10/2004 Katase ..... 359/296
2004/0246562 A1 * 12/2004 Chung et al. ..... 359/296

(Continued)

FOREIGN PATENT DOCUMENTS

JP 2002-116733 4/2002

(Continued)

OTHER PUBLICATIONS

Communication from Korean Patent Office regarding counterpart application, Feb. 1, 2007.

*Primary Examiner*—Prabodh M Dharia
(74) *Attorney, Agent, or Firm*—Harness, Dickey & Pierce, P.L.C.

(57) ABSTRACT

A method for driving an electrophoretic device that includes an electrophoretic element between a common electrode and a pixel electrode, the electrophoretic element including electrophoretic particles, the method including applying voltages on the common electrode and the pixel electrode, thereby conducting an image rewrite process, wherein the image rewrite process includes a first reset period process, during which a voltage-equivalent of a first gradation, which has a higher level of brightness than an intermediate gradation, is applied between the common electrode and the pixel electrode, thereby causing electrophoretic particles to migrate; and a second reset period process, during which a voltage-equivalent of a third gradation which is between a second gradation and the first gradation is applied between the common electrode and the pixel electrode, the second gradation being at a lower level of brightness than the intermediate gradation, thereby causing the electrophoretic particles to migrate.

17 Claims, 11 Drawing Sheets

U.S. PATENT DOCUMENTS

| | | | | |
|---|---|---|---|---|
| 2005/0179641 | A1* | 8/2005 | Zhou et al. | 345/107 |
| 2005/0206585 | A1* | 9/2005 | Stewart et al. | 345/34 |
| 2006/0274030 | A1* | 12/2006 | Johnson et al. | 345/107 |

FOREIGN PATENT DOCUMENTS

| | | |
|---|---|---|
| JP | 2003-140199 | 5/2003 |
| JP | 2004-004714 | 1/2004 |
| JP | 2004-101746 | 4/2004 |
| KR | 10-2004-0044449 | 5/2004 |
| WO | WO-03/019279 | 3/2003 |
| WO | WO2004-072942 | 8/2004 |
| WO | WO2006/031347 | 3/2006 |

* cited by examiner

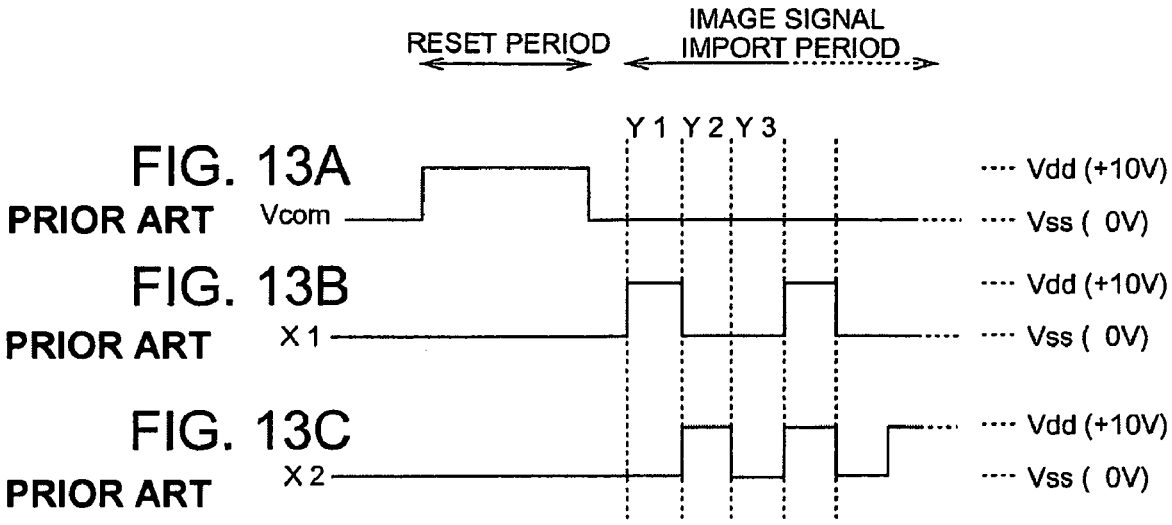
FIG. 13A PRIOR ART
FIG. 13B PRIOR ART
FIG. 13C PRIOR ART
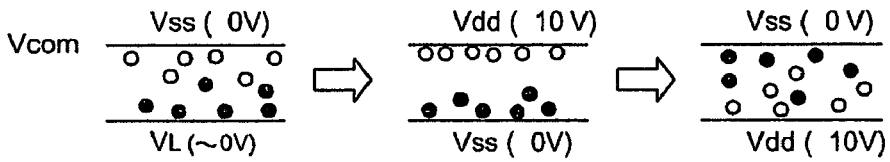
FIG. 14A PRIOR ART
FIG. 14B PRIOR ART
FIG. 14C PRIOR ART
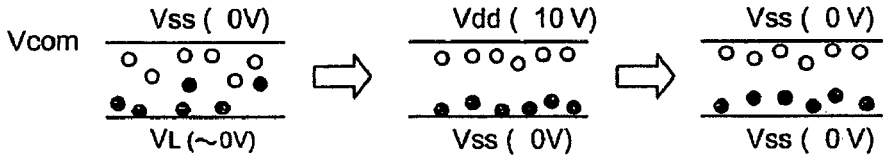
FIG. 15A PRIOR ART
FIG. 15B PRIOR ART
FIG. 15C PRIOR ART
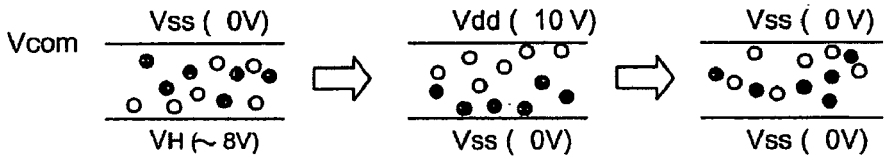
FIG. 16A PRIOR ART
FIG. 16B PRIOR ART
FIG. 16C PRIOR ART

ELECTROPHORETIC DEVICE, ELECTRONIC APPARATUS, AND METHOD FOR DRIVING THE ELECTROPHORETIC DEVICE

BACKGROUND

1. Technical Field

The present invention relates to an electrophoretic device, provided with a dispersal system including electrophoretic particles, a driving method thereof, and an electronic apparatus that utilizes the device.

2. Related Art

A phenomenon called electrophoresis, in which electrophoretic particles are moved by a coulomb's power, when an electric field is applied to a dispersal system, and the electrophoretic particles are distributed in a solution, is known, and electrophoretic devices, which utilize that phenomenon have been developed. Such electrophoretic devices are disclosed in literatures such as JP-A-2002-116733, JP-A-2003-140199, JP-A-2004-004714, and JP-A-2004-101746. These are examples of the related art. However, common electrophoretic devices involve a problem of image quality, leaving much room for improvement. Specific examples related to this problem will be described hereafter.

FIG. 12 is a diagram that describes an example structure of circuitry for an active-matrix electrophoretic device. The electrophoretic device shown in the diagram has a plurality of scanning lines and a plurality of data lines that are arranged orthogonally to each other, the cross points of which have the electrophoretic elements installed on them. A dispersal system is laid between a common electrode and a pixel electrode that are arranged to face each other, constituting the electrophoretic element. A current is supplied to each electrophoretic element by a transistor connected to the scanning line and the data line.

FIGS. 13A through 13C are wave pattern diagrams that describe the common method for driving the electrophoretic device with the structure shown in FIG. 12. In the driving method shown in FIG. 13, a reset. period that resets all the pixels to be displayed as white is provided, prior to an image signal import period. During this reset period, a low power source potential Vss (for instance, 0V) is applied to the pixel electrodes of the entire pixels, and a high power source potential Vdd (for instance, +10V) is applied as a potential Vcom (a common potential) of the common electrode. Thereafter, in the subsequent image signal import period, the low power source potential Vss is applied as the common potential Vcom, and potentials corresponding to the content of the display image is applied to each pixel electrode via each data line.

FIGS. 14A, . . . 14C through 17A, . . . 17C are drawings that schematically describe behavior of electrophoretic particles in a spatial distribution, driven with the common driving method shown in FIGS. 13A through 13C. In FIGS. 14A, . . . 14C through 17A, . . . 17C, the behavior of particles of the electrophoretic device with a two-particle system, where the particles shown in white (white particles) are charged with a negative potential and the particles shown in black (black particles) are charged with a positive potential, is shown.

The behavior of the electrophoretic particles at a pixel (1,1) where both data line signal X1 and the scanning line signal Y1 are supplied, and where, for instance, the previous screen is displayed as white, and the next screen is displayed as black, is shown in FIGS. 14A through 14C. In the previous screen, as shown in FIG. 14A, the potential Vss is applied as the common potential Vcom to the common electrode, and a potential $V_L$ (approximately 0V) is applied to the pixel electrode; thereby the pixel is displayed as white (to be more precise, a grayish white). In the reset period, as shown in FIG. 14B, the potential Vdd is applied as the common potential Vcom, and the potential Vss is applied to the, pixel electrode; thereby the pixel is displayed as white (to be more precise, a strong white), as part of the reset operation. In the next screen, as shown in FIG. 14C, the potential Vss is applied as the common potential Vcom, and the potential Vdd is applied to the pixel electrode; thereby the pixel is displayed as black (to be more precise, a grayish black). Here, since the pixel (1,1) is displayed as strong white during the reset period immediately beforehand, the electrophoretic particles migrate insufficiently; therefore it involves the problem that a subsequent display of black is not black enough.

The behavior of the electrophoretic particles at a pixel (1,2) where both data line signal X1 and the scanning line signal Y2 are supplied, and where the previous screen as well as the next screen are displayed as white, is shown in FIGS. 15A through 15C. In the previous screen, as shown in FIG. 15A, the potential Vss is applied as the common potential Vcom to the common electrode, and a potential $V_L$ (approximately 0V) is applied to the pixel electrode; thereby the pixel is displayed as white (to be more precise, a grayish white). In the reset period, as shown in FIG. 15B, the potential Vdd is applied as the common potential Vcom, and the potential Vss is applied to the pixel electrode; thereby the pixel is displayed as white (to be more precise, a strong white), as part of the reset operation. In the next screen, as shown in FIG. 15C, the potential Vss is applied as the common potential Vcom, and the potential Vdd is applied to the pixel electrode; thereby the pixel is displayed as white. Here, the migration of the electrophoretic particles exceeds the necessary, to the extent that the pixel displayed in white is actually a strong white, which causes a relative difference in the brightness from the other pixels, hence causing a disadvantage of the visual afterimage. Moreover, if the pixel being displayed as white further persists, the particles become fixed, white ones to the common electrode side and the black ones to the pixel electrode side. Hence, when the pixel is to be displayed in black, the migration of the particles are less likely to occur, causing the pixel not to be displayed as a desired black. Further, since there is no potential difference between the electrodes when white is displayed, the particles gradually diffuse, causing the white display to turn gray.

The behavior of the electrophoretic particles at a pixel (2,1) where both data line signal X2 and the scanning line signal Y1 are supplied, and where the previous screen is displayed as black, and the next screen is displayed as white, is shown in FIGS. 16A through 16C. In the previous screen, as shown in FIG. 16A, the potential Vss is applied as the common potential Vcom to the common electrode, and a potential $V_H$ (approximately 8V) is applied to the pixel electrode; thereby the pixel is displayed as black (to be more precise, a whitish black). In the reset period, as shown in FIG. 16B, the potential Vdd is applied as the common potential Vcom, and the potential Vss is applied to the pixel electrode; thereby the pixel is displayed as white (to be more precise, a grayish white), as part of the reset operation. In the next screen, as shown in FIG. 16C, the potential Vss is applied as the common potential Vcom, and the potential Vdd is applied to the pixel electrode; thereby the pixel is displayed as white. Here, the migration of the electrophoretic particles is less than is necessary, to the extent that the display of the next screen as white actually turns out to be a blackish white, which causes a relative difference in the brightness from the other pixels, hence causing an unfavorable condition of a visual afterimage. Specifically, there is a difference in the level of whiteness from the above-mentioned pixel (1,2).

The behavior of the electrophoretic particles at a pixel (2,2) where both data line signal X2 and the scanning line signal Y2 are supplied, and where the previous screen as well as the next screen is displayed as black, is shown in FIGS. 17A through 17C. In the previous screen, as shown in FIG. 17A, the potential Vss is applied as the common potential Vcom to the common electrode, and a potential $V_H$ (approximately 8V) is applied to the pixel electrode; thereby the pixel is displayed as black (to be more precise, a whitish black). In the reset period, as shown in FIG. 17B, the potential Vdd is applied as the common potential Vcom, and the potential Vss is applied to the pixel electrode; thereby the pixel is displayed as white (to be more precise, a grayish white), as part of the reset operation. In the next screen, as shown in FIG. 17C, the potential Vss is applied as the common potential Vcom, and the potential Vdd is applied to the pixel electrode; thereby the pixel is displayed as black. Here, since the electrophoretic particles migrate sufficiently, the display of the next screen as black has an appropriate brightness. However, an unfavorable condition, in which the level of blackness is different compared to the aforementioned pixel (1,1), occurs.

As described, there are various unfavorable conditions existing in the common driving method, and it has been difficult to improve the image quality of the electrophoretic device.

SUMMARY

The advantage of the invention is to provide a technique that allows the improvement of the image quality of electrophoretic devices.

According to a first aspect of the invention, a method for driving an electrophoretic device, which includes: an electrophoretic element, in which a dispersal system that includes electrophoretic particles is laid between a common electrode and a pixel electrode; a driving circuit for driving the electrophoretic element by applying a voltage between the common electrode and the pixel electrode; and a controller for controlling the driving circuit; the method including: an image rewrite period process for controlling the driving circuit by the controller, and applying a voltage on the common electrode and the pixel electrode, thereby conducting an image rewrite, the image rewrite period process including a reset period and an image signal import period that follows the reset period; wherein the reset period includes: a first reset period process, during which a voltage-equivalent of a first gradation, which has a higher level of brightness than an intermediate gradation, is applied between the common electrode and the pixel electrode, thereby causing the electrophoretic particles to migrate; and a second reset period process, during which a voltage-equivalent of a third gradation which is between a second gradation and the first gradation is applied between the common electrode and the pixel electrode, the second gradation being at a lower level of brightness than the intermediate gradation, thereby causing the electrophoretic particles to migrate.

With the driving method described above, performing the second reset operation, of which the gradation is equivalent to the intermediate gradation, during the first reset period after the first reset operation, allows the electrophoretic particles to be more mobile. Consequently, each electrophoretic particle can be controlled, independently from the display contents (gradations) of the previous and next screen, hence it is in an appropriate distribution status. As a result, the expression of each pixel's gradation is apt, and the image quality can be improved.

It is desirable that during the first reset period, a voltage-equivalent of the highest level of brightness be applied as the voltage-equivalent of the aforementioned first gradation; and that during the second reset period, a voltage-equivalent of a level of brightness lower than that of the intermediate gradation and higher than that of the second gradation be applied as the voltage-equivalent of the third gradation.

Hence, the directions of migration of the electrophoretic particles in the first reset operation and in the second reset operation become opposite to each other, where this first reset operation causes all the pixels to gain high brightness (a so-called white reset). Thus it is possible to effectively conduct the second reset operation.

More specifically, it is desirable that the voltage-equivalent of the first gradation in the above-mentioned first reset period be achieved by applying a high power source potential Vdd to the common electrode, while also applying a common potential Vc, which is lower than the high power source potential Vdd, to the pixel electrode; and that the voltage-equivalent of the third gradation in the above-mentioned second reset period be achieved by applying the common potential Vc to the common electrode, while also applying a reset potential $V_{RH}$, which is higher than the common potential Vc and lower than the high power source potential Vdd, to the pixel electrode.

By utilizing the high power source potential and the common potential, the appropriate voltages, which are equivalent to the first or the third gradation, can easily be generated.

Further, it is desirable that, during the aforementioned image signal import period, an image write-in be conducted, by applying the prescribed common potential Vc to the common electrode, while also applying any one of a relatively positive or negative potential based on the common potential Vc to the pixel electrode. More specifically, it is appropriate that the common potential Vc be set to a potential lower than the high power source potential Vdd, and higher than a low power source potential Vss, (in other words, fulfilling a condition Vss<Vc<Vdd), and that the potential applied to the pixel electrode be set to either $V_{DH}$ or $V_{DL}$, expressed as $V_{DH}$>Vc and $V_{DL}$<Vc. The $V_{DH}$ and the $V_{DL}$ can be set to, for instance, Vdd ($V_{DH}$=Vdd), and Vss ($V_{DL}$=Vss).

Hence, a potential difference remains between the pixel electrode and the common electrode, in the case of high-brightness gradations (for instance, a white display) or of low-brightness. Hence, the diffusion of the electrophoretic particles can be suppressed, and the gradation can be maintained appropriately.

In this case, the common potential Vc may be set to an intermediate potential lower than the high power source potential Vdd and higher than the low power source potential Vss, expressed as (Vdd +Vss)/2.

This allows an easy generation of the common potential Vc.

Moreover, it is desirable that the electrophoretic device further include a holding capacitor in which one electrode is connected to the common electrode and the other electrode is connected to the pixel electrode.

This allows a stabilization of the potential of the common electrode, thereby stabilizing the voltage applied to the electrophoretic element.

According to a second aspect of the invention, a method for driving an electrophoretic device, which includes: an electrophoretic element, in which a dispersal system that includes electrophoretic particles is laid between a common electrode and a pixel electrode; a driving circuit for driving the electrophoretic element by applying a voltage between the common electrode and the pixel electrode; and a controller for controlling the driving circuit; the method including: an image rewrite period process for controlling the driving circuit by the controller, and applying a voltage on the common electrode and the. pixel electrode, thereby conducting an image rewrite, the image rewrite period process including a reset period and an image signal import period that follows the reset period; wherein the reset period includes: a first reset period process, during which a voltage-equivalent of a first gradation, which has a lower level of brightness than an intermediate gradation, is applied between the common electrode and the pixel electrode, thereby causing the electrophoretic particles to migrate; and a second reset period process, during which a voltage-equivalent of a third gradation which is between a second gradation and the first gradation is applied between the common electrode and the pixel electrode, the second gradation being at a higher level of brightness than the intermediate gradation, thereby causing the electrophoretic particles to migrate.

With the driving method described above, performing the second reset operation, of which the gradation is equivalent to the intermediate gradation, during the first reset period after the first reset operation, allows the electrophoretic particles to be more mobile. Consequently, each electrophoretic particle can be controlled, independently from the display contents (gradations) of the previous and next screen, hence it is in an appropriate distribution status. As a result, the expression of each pixel's gradation is apt, and the image quality can be improved.

It is desirable that during the first reset period, a voltage-equivalent of the lowest level of brightness be applied as the voltage-equivalent of the aforementioned first gradation; and that during the second reset period, a voltage-equivalent of a level of brightness higher than that of the intermediate gradation and lower than that of the second gradation be applied as the voltage-equivalent of the third gradation.

Hence, the directions of migration of the electrophoretic particles in the first reset operation and in the second reset operation become opposite to each other, where this first reset operation causes all the pixels to gain low brightness (a so-called black reset). Thus it is possible to effectively conduct the second reset operation.

More specifically, it is desirable that the voltage-equivalent of the first gradation in the above-mentioned first reset period be achieved by applying a low power source potential Vss to the common electrode, while also applying a common potential Vc, which is higher than the low power source potential Vss, to the pixel electrode; and that the voltage-equivalent of the third gradation in the above-mentioned second reset period be achieved by applying the common potential Vc to the common electrode, while also applying a reset potential $V_{RL}$, which is lower than the common potential Vc and higher than the low power source potential Vss, to the pixel electrode.

By utilizing the low power source potential and the common potential, the appropriate voltages, which are equivalent to the first or the third gradation, can easily be generated.

Further, it is desirable that, during the aforementioned image signal import period, an image write-in be conducted, by applying the prescribed common potential Vc to the common electrode, while also applying any one of a relatively positive or negative potential based on the common potential Vc to the pixel electrode. More specifically, it is appropriate that the common potential Vc be set to a potential lower than the high power source potential Vdd, and higher than a low power source potential Vss, (in other words, fulfilling a condition Vss<Vc<Vdd), and that the potential applied to the pixel electrode be set to either $V_{DH}$ or $V_{DL}$, expressed as $V_{DH}$>Vc and $V_{DL}$<Vc. The $V_{DH}$ and the $V_{DL}$ can be set to, for instance, Vdd ($V_{DH}$=Vdd), and Vss ($V_{DL}$=Vss).

Hence, a potential difference remains between the pixel electrode and the common electrode, in the case of low-brightness gradations (for instance, a black display) or of high-brightness. Hence, the diffusion of the electrophoretic particles can be suppressed, and the gradation can be maintained appropriately.

In this case, the common potential Vc may be set to an intermediate potential lower than the high power source potential Vdd and higher than the low power source potential Vss, expressed as (Vdd+Vss)/2.

This allows an easy generation of the common potential Vc.

Moreover, it is desirable that the electrophoretic device further include a holding capacitor in which one electrode is connected to the common electrode and the other electrode is connected to the pixel electrode.

This allows a stabilization of the potential of the common electrode, thereby stabilizing the voltage applied to the electrophoretic element.

According to a third aspect of the invention, an electrophoretic device, including: an electrophoretic element, in which a dispersal system that includes electrophoretic particles is laid between a common electrode and a pixel electrode; a driving circuit for driving the electrophoretic element by applying a voltage between the common electrode and the pixel electrode; a controller for controlling the driving circuit; an image rewrite period, during which the driving circuit applies a voltage to the common electrode and to the pixel electrode in order to conduct an image rewrite, the image rewrite period including a reset period followed by an image signal import period; wherein the reset period includes: a first reset period, during which a voltage-equivalent of a first gradation, which has a higher level of brightness than an intermediate gradation, is applied between the common electrode and the pixel electrode, thereby causing the electrophoretic particles to migrate; and a second reset period, during which a voltage-equivalent of a third gradation, which is between a second gradation and the first gradation, is applied between the common electrode and the pixel electrode, the second gradation being at a lower level of brightness than the intermediate gradation, thereby causing the electrophoretic particles to migrate.

With such structure, the expression of each pixel's gradation is apt, and the image quality can be improved.

It is desirable that the aforementioned controller apply: during the first reset period, a voltage-equivalent of the highest level of brightness as a voltage-equivalent of the first gradation; and during the second reset period, a voltage-equivalent of a level of brightness lower than that of the intermediate gradation and higher than that of the second gradation, as the voltage-equivalent of the third gradation.

Hence, the directions of migration of the electrophoretic particles in the first reset operation and in the second reset operation become opposite to each other, where this first reset operation causes all the pixels to gain high brightness (a so-called white reset). Thus it is possible to effectively conduct the second reset operation.

More specifically, it is desirable that the aforementioned controller achieve: the voltage-equivalent of the first gradation in the above-mentioned first reset period, by applying the high power source potential Vdd to the common electrode, while also applying the common potential Vc, which is lower than the high power source potential Vdd, to the pixel electrode; and the voltage-equivalent of the third gradation in the above-mentioned second reset period, by applying the common potential Vc to the common electrode, while also applying a reset potential $V_{RH}$, which is higher than the common potential Vc and lower than the high power source potential Vdd, to the pixel electrode.

By utilizing the high power source potential and the common potential; the appropriate voltages, which are equivalent to the first or the third gradation, can easily be generated.

Further, it is desirable that the above-referenced controller conduct an image write-in during the image signal import period, by applying the prescribed common potential Vc to the common electrode, while also applying any one of a relatively positive or negative potential based on the common potential Vc, to the pixel electrode. More specifically, it is appropriate that the controller set: the common potential Vc to a potential lower than the high power source potential Vdd and higher than the low power source potential Vss (in other words, fulfilling the condition Vss<Vc<Vdd); and the potential applied to the pixel electrode, to either $V_{DH}$ or $V_{DL}$, expressed as $V_{DH}$>Vc and $V_{DL}$<Vc. The $V_{DH}$ and the $V_{DL}$ can be set to, for instance, Vdd($V_{DH}$=Vdd), and Vss ($V_{DL}$=Vss).

Hence, a potential difference remains between the pixel electrode and the common electrode, in the case of high-brightness gradations (for instance, a white display) or of low-brightness. Hence, the diffusion of the electrophoretic particles can be suppressed, and the gradation can be maintained appropriately.

In this case, the common potential Vc may be set to an intermediate potential lower than the high power source potential Vdd and higher than the low power source potential Vss, expressed as (Vdd+Vss)/2.

This allows an easy generation of the common potential Vc.

Moreover, it is desirable that the electrophoretic device further include a holding capacitor in which one electrode is connected to the common electrode and the other electrode is connected to the pixel electrode.

This allows a stabilization of the potential of the common electrode, thereby stabilizing the voltage applied to the electrophoretic element.

According to a forth aspect of the invention, an electrophoretic device, including: an electrophoretic element, in which a dispersal system that includes electrophoretic particles is laid between a common electrode and a pixel electrode; a driving circuit for driving the electrophoretic element by applying a voltage between the common electrode and the pixel electrode; a controller for controlling the driving circuit; an image rewrite period, during which the driving circuit applies a voltage to the common electrode and to the pixel electrode in order to conduct an image rewrite, the image rewrite period including a reset period followed by an image signal import period; wherein the reset period includes: a first reset period, during which a voltage-equivalent of a first gradation, which has a lower level of brightness than an intermediate gradation, is applied between the common electrode and the pixel electrode, thereby causing the electrophoretic particles to migrate; and a second reset period, during which a voltage-equivalent of a third gradation, which is between a second gradation and the first gradation, is. applied between the common electrode and the pixel electrode, the second gradation being at a higher level of brightness than the intermediate gradation, thereby causing the electrophoretic particles to migrate.

With such structure, the expression of each pixel's gradation is also apt, and the image quality can be improved.

It is desirable that the aforementioned controller apply: during the first reset period, a voltage-equivalent-of the lowest level of brightness as a voltage-equivalent of the first gradation; and during the second reset period, a voltage-equivalent of a level of brightness higher than that of the intermediate gradation and lower than that of the second gradation as the voltage-equivalent of the third gradation.

Hence, the directions of migration of the electrophoretic particles in the first reset operation and in the second reset operation become opposite to each other, where this first reset operation causes all the pixels to gain low brightness (a so-called black reset). Thus it is possible to effectively conduct the second reset operation.

More specifically, it is desirable that the aforementioned controller achieve: the voltage-equivalent of the first gradation in the first reset period, by applying the low power source potential Vss to the common electrode, while also applying the common potential Vc, which is higher than the low power source potential Vss, to the pixel electrode; and the voltage-equivalent of the third gradation in the second reset period, by applying the common potential Vc to the common electrode, while also applying a reset potential $V_{RL}$, which is lower than the common potential Vc and higher than the low power source potential Vss, to the pixel electrode.

By utilizing the low power source potential and the common potential, the appropriate voltages, which are equivalent to the first or the third gradation, can easily be generated.

Further, it is desirable that the above-referenced controller conduct an image write-in during the image signal import period, by applying the prescribed common potential Vc to the common electrode, while also applying any one of a relatively positive or negative potential based on the common potential Vc to the pixel electrode. More specifically, it is appropriate that the controller set: the common potential Vc to a potential lower than the high power source potential Vdd and higher than the low power source potential Vss (in other words, fulfilling the condition Vss<Vc<Vdd); and the potential applied to the pixel electrode, to either $V_{DH}$ or $V_{DL}$, expressed as $V_{DH}$>Vc and $V_{DL}$<Vc. The $V_{DH}$ and the $V_{DL}$ can be set to, for instance, Vdd($V_{DH}$=Vdd), and Vss($V_{DL}$=Vss).

Hence, a potential difference remains between the pixel electrode and the common electrode, in the case of low-brightness gradations (for instance, a black display), or of high-brightness. Hence, the diffusion of the electrophoretic particles can be suppressed, and the gradation can be maintained appropriately.

In this case, the common potential Vc may be set to an intermediate potential lower than the high power source potential Vdd and higher than the low power source potential Vss, expressed as (Vdd+Vss)/2.

This allows an easy generation of the common potential Vc.

Moreover, it is desirable that the electrophoretic device further include a holding capacitor in which one electrode is connected to the common electrode and the other electrode is connected to the pixel electrode.

This allows a stabilization of the potential of the common electrode, thereby stabilizing the voltage applied to the electrophoretic element.

According to a fifth aspect of the invention, an electronic apparatus is provided with the above-referenced electrophoretic device. Here, "an electronic apparatus" indicates general apparatuses with certain functions. Thus there is no specific limitation to the structure, and may include, for instance, an electronic paper, an electronic book, an IC card, a PDA, an electronic notebook, or the like.

This allows attaining an electronic apparatuses that excel in the quality of images in display units.

BRIEF DESCRIPTION OF THE DRAWINGS

The invention will be described with reference to the accompanying drawings, wherein like numbers reference like elements.

FIGS. 13A through 13C are wave pattern diagrams that describe the common method for driving the electrophoretic device with the structure shown in FIG. 12.

FIGS. 14A through 14C are drawings that. schematically describe the behavior of electrophoretic particles in a spatial distribution, driven with the common driving method shown in FIGS. 13A through 13C.

FIGS. 15A through 15C are drawings that schematically describe the behavior of electrophoretic particles in a spatial distribution, driven with the common driving method shown in FIGS. 13A through 13C.

FIGS. 16A through 16C are drawings that schematically describe the behavior of electrophoretic particles in a spatial distribution, driven with the common driving method shown in FIGS. 13A through 13C.

DESCRIPTION OF EXEMPLARY EMBODIMENTS

Embodiments of the invention will now be described with references to the accompanying drawings.

Figure 1:
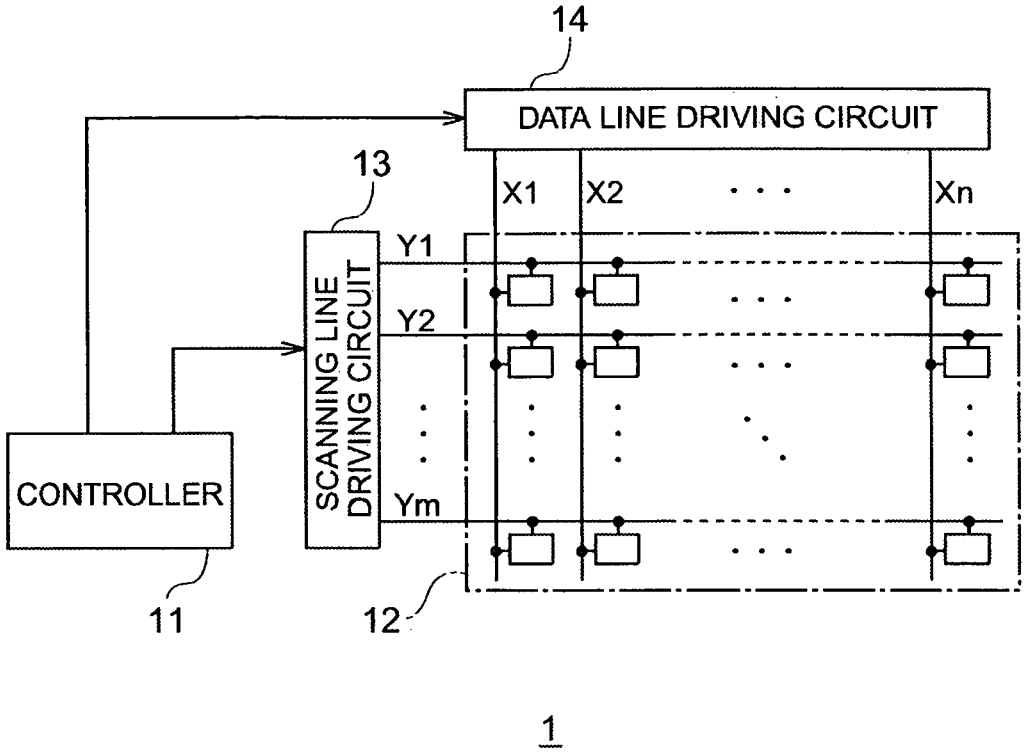
FIG. 1 is a block diagram schematically describing circuitry composition of an electrophoretic display device in an embodiment of the present invention.

FIG. 1 is a block diagram schematically describing circuitry composition of an electrophoretic display device in an embodiment of the present invention. An electrophoretic display device 1 according to the embodiments as shown in FIG. 1 is composed including a controller 11, a display unit 12, a scanning line driving circuit 13, and a data line driving circuit 14.

The controller 11 controls the scanning line driving circuit 13 and the data line driving circuit 14, and is composed including an image signal processing circuit or a timing generator (not shown). The controller 11 generates an image signal (image data) that indicates an image which will be displayed in the display unit 12, a reset data for conducting a reset at the time of image re-write, and various other signals (clock signal, etc.), and outputs them to the scanning line driving circuit 13 or the data line driving circuit 14.

The display unit 12 is provided with: a plurality of data lines arranged in parallel along the direction of X-axis, a plurality of scanning lines arranged in parallel along the direction of Y-axis, and pixel circuits arrayed on each of the points where these data lines and the scanning lines cross. The display unit 12 conducts an image display with electrophoretic elements included in the pixel circuits.

The scanning line driving circuit 13 is connected to each of the scanning lines in the display unit 12, selecting one of these scanning lines, and supplies a prescribed scanning line signal from scanning line signals Y1, Y2, . . . , Ym to the selected scanning line. An active period (H-level period) sequentially shifts among the scanning line signals Y1, Y2, . . . , Ym. The pixel circuit connected to each of the scanning lines are sequentially switched on by the scanning line signal being output to each scanning line.

The data line driving circuit 14 is connected to each of the data lines in the display unit 12, and supplies data signals X1, X2, . . . , Xn to each pixel circuit selected by the scanning line driving circuit 13.

The aforementioned controller 11 is equivalent to the "controller" referred to in the claims of the invention, and the scanning line driving circuit 13 and the data line driving circuit 14 are equivalent to the "driving circuit" referred to in the claims of the invention.

Figure 2:
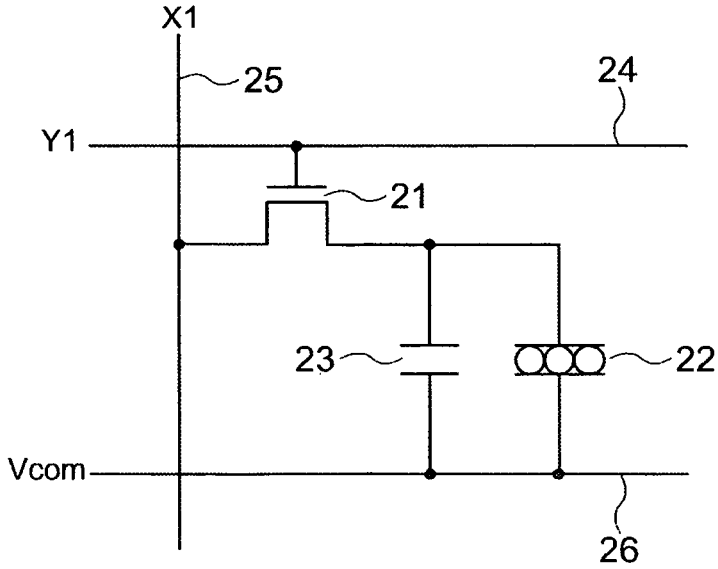
FIG. 2 is a circuit diagram that describes the structure of each pixel circuit.

FIG. 2 is a circuit diagram that describes a structure of each pixel circuit. A pixel circuit shown in FIG. 2 is composed including a transistor 21 for switching, an electrophoretic element 22, and a holding capacitor 23. The transistor 21 is, for instance an N-channel transistor, and its gate, source, and drain are connected to a scanning line 24, a data line 25, and a pixel electrode of the electrophoretic element 22, respectively. A dispersal system is laid between the pixel electrode installed in each pixel and a common electrode 26 used by each pixel commonly, constituting the electrophoretic element 22. The holding capacitor 23 is connected in parallel to the electrophoretic element 22. More specifically, one electrode of the holding capacitor 23 is connected to the source of the transistor, and the other electrode is connected to the common electrode 26.

Figure 3:
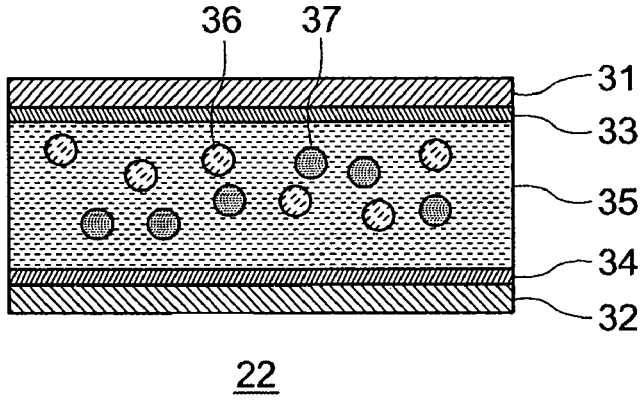
FIG. 3 is a schematic sectional drawing that describes an example structure of an electrophoretic element.

FIG. 3 is a schematic sectional drawing that describes an example structure of the electrophoretic element. As shown in FIG. 3, the electrophoretic element 22 according to the embodiment is structured so that a dispersal system 35, which contains electrophoretic particles 36 and 37, is interstitial between a pixel electrode 33 and a common electrode 34, where the pixel electrode 33 and the common electrode 34 are respectively formed on a substrate 31 and a substrate 32, both made of glass or resin etc. In the embodiment, the electrophoretic particles 36 are white grains electrically charged with negative potential, and the electrophoretic particles 37 are black grains electrically charged with positive potential. The spatial alignment of these electrophoretic particles 36 and 37 is changed by controlling the voltage applied between the pixel electrode 33 and the common electrode 34, so that the pixels form a gradation from white and black, thereby displaying an image.

The electrophoretic display device 1 according to the embodiment has an aforementioned structure. Hereafter, a method of driving each electrophoretic element in the electrophoretic display device 1 will be described.

Figure 4:
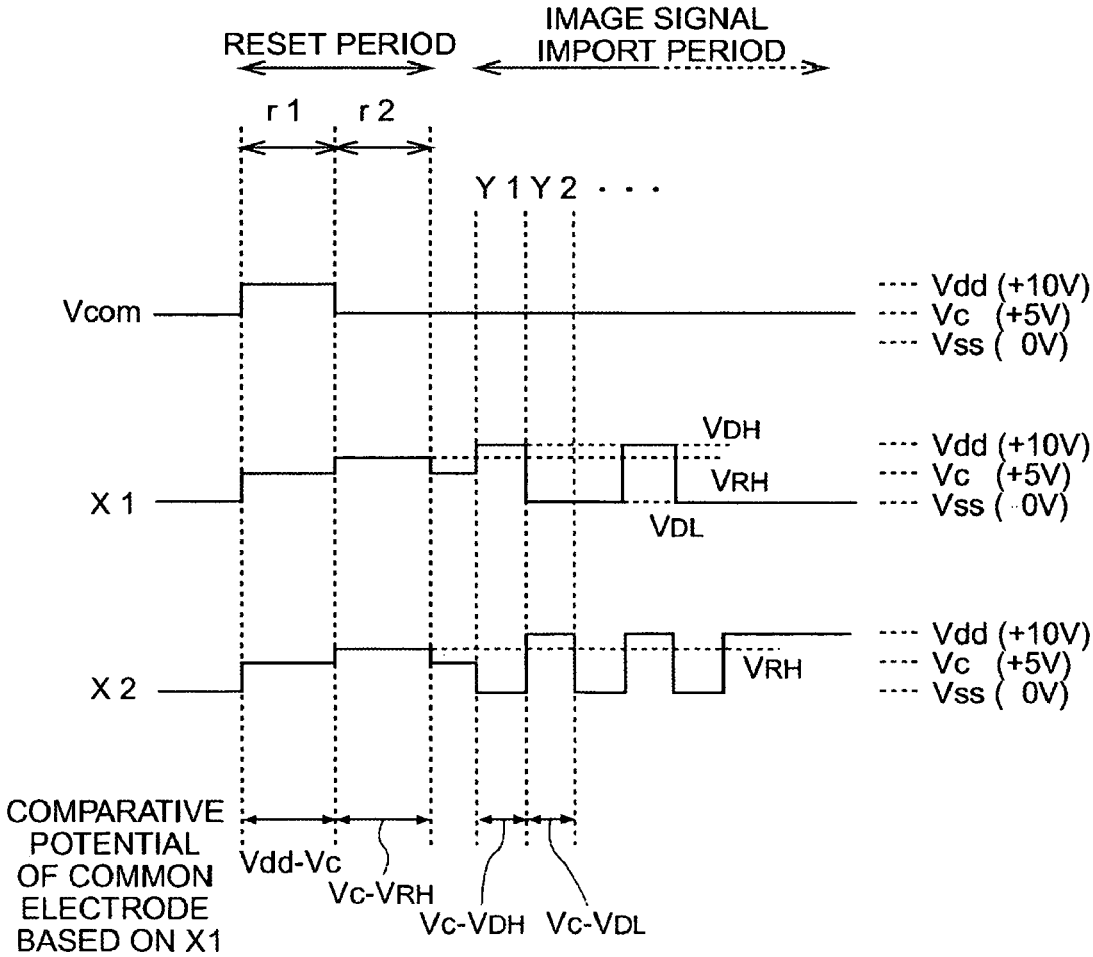
FIG. 4 is a wave pattern diagram that describes a method for driving each electrophoretic element.

FIG. 4 is a wave pattern diagram that describes a method for driving each electrophoretic element in the electrophoretic display device 1 according to the embodiment. In the electrophoretic display device 1 according to the embodiment, an image rewrite period, during which the controller 11 controls the scanning line driving circuit 13 and the data line driving circuit 14, in order to conduct an image rewrite, and applies voltages to the common electrode and the pixel electrode of each electrophoretic element 22, includes a reset period and an image signal import period following the reset period. As shown in FIG. 4, the reset period includes a first reset period r1 and a second reset period r2, wherein during the first reset period r1, a voltage equivalent to a first gradation, which has a higher level of brightness than an intermediate gradation, is provided between the common electrode and the pixel electrode, thereby moving the electrophoretic particles, and wherein during the second reset period r2, a voltage, which is equivalent to a third gradation located in between a second gradation and the first gradation, the second gradation being at a lower level of brightness than the intermediate gradation, is provided between the common electrode and the pixel electrode, thereby moving the, electrophoretic particles.

Here, it is desirable to set the reset period to the range of $0.5\tau$ to $2\tau$ (inclusive) where $\tau$ is a response time of the electrophoretic element 22. This is because, generally, if the reset period is shorter than $0.5\tau$, then inadequate electrophoretic migration occurs, causing the reset to function insufficiently, and if the reset period is longer than $2\tau$, it causes a visual flickering. Moreover, it is desirable to set the second reset period r2 to the range of 40 to 60% (inclusive) of the entire reset period. This is because if the second reset period is longer than 40% of the entire reset period, then the electrophoretic particles start moving, causing the gradation of pixel to turn from white to gray, and at the same time, if it is shorter than 60%, then it is possible to white out the image in the first reset period r1.

According to the embodiment, all the pixels are reset to the highest gradation in the first reset period r1, by applying a voltage-equivalent of the highest level of brightness (in other words, the strongest white) as the voltage-equivalent of the first gradation. Further, all the pixels are reset to the intermediate gradation in the second reset period r2, by applying a voltage-equivalent of the level of brightness lower than that of the intermediate gradation and higher than that of the second gradation, as the voltage-equivalent of the third gradation. More specifically, the voltage equivalent to the first gradation in the first reset period is attained by applying a high power source potential Vdd (for instance, +10V) to the common electrode, while also applying a common potential Vc (for instance, +5V), which is lower than the Vdd, to the pixel electrode. Here, the relative potential of the common electrode, when compared to a reference point of the pixel electrode, is Vdd−Vc. In this embodiment, the relation of potentials is configured to be Vss<Vc<Vdd, hence Vdd−Vc is a positive potential, and particles charged with negative potential (for example, the white particles) are pulled to the common electrode. Moreover, the voltage equivalent to the third gradation in the second reset period is attained by applying the common potential Vc (for instance, +5V) to the common electrode, while also applying a reset potential $V_{RH}$, which is higher than the common potential Vc and lower than the high power source potential Vdd, or in other words, a potential that fulfills the relationship $Vc<V_{RH}<Vdd$ (for instance, +7.5V), to the pixel electrode. Here, the relative potential of the common electrode, when compared to a reference point of the pixel electrode, is expressed with $Vc-V_{RH}$, which is a negative potential fulfilling the relationship $Vc<V_{RH}<Vdd$, and particles charged with positive potential (for example, the black particles) are pulled to the common electrode.

During the image signal import period, an image write-in is conducted by applying the common potential Vc to the common electrode, while applying either the potential $V_{DH}$ ($V_{DH}>Vc$), relatively positive when compared to a reference point of the common potential Vc, or the relatively negative potential $V_{DL}$($V_{DL}<Vc$), to the pixel electrode. The common potential Vc needs to be lower than the high power source potential Vdd, and higher than a low power source potential (Vss<Vc<Vdd). The common potential Vc can easily be generated by setting it to an intermediate potential lower than the high power source potential Vdd and higher than the low power source potential Vss, which can be expressed as (Vdd+Vss)/2(=+5V), where Vdd is +10V and Vss is 0V, for instance.

Figure 5A:
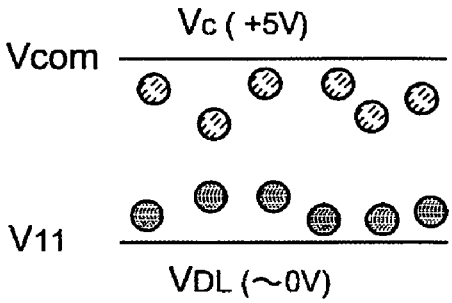
FIGS. 5A through 5D are drawings that schematically describe the behavior of electrophoretic elements.

FIGS. 5A, . . . 5D through 8A, . . . 8D are drawings that schematically describe the behavior of the electrophoretic element, driven with the driving method according to the embodiment, in which the behavior, corresponding to the drive wave patterns of the electrophoretic particles 36 and 37, shown as examples in FIG. 4, is shown. Hereafter, the electrophoretic particles 36, which are charged with a negative potential, is called "white particles", and the electrophoretic particles 37, which are charged with a positive potential, is called "black particles".

Figure 5B:
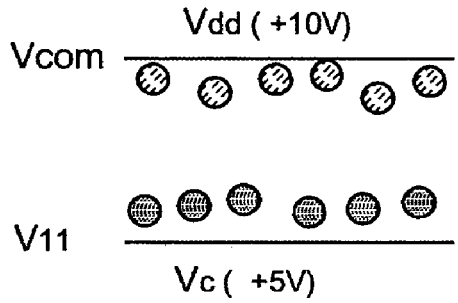
Figure 5C:
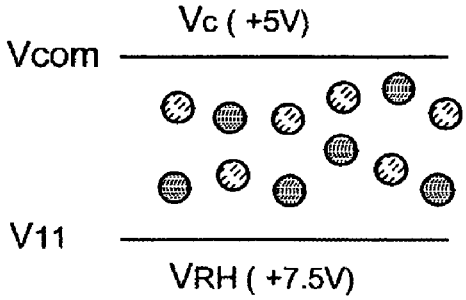
Figure 5D:
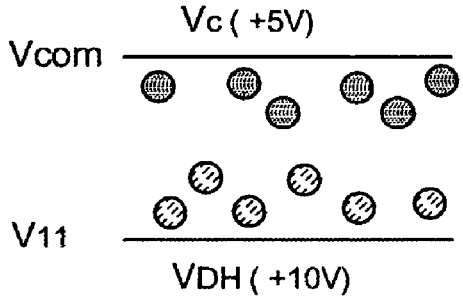

FIGS. 5A through 5D schematically show the behavior of the electrophoretic particles, at a pixel (1,1) where both the data line signal X1 and the scanning line signal Y1 are supplied, and in the case where the previous screen is displayed as white, and the next screen is displayed as black. In the previous screen, as shown in FIG. 5A, the potential Vc (+5V) is applied as a common potential Vcom to the common electrode, and the potential $V_{DL}$ (approximately 0V) is applied to the pixel electrode. Hence, the particles are pulled, the white particles to the common electrode (upper electrode), and the black particles to the pixel electrode (lower electrode), thereby the pixel (1,1) is at approximately the highest level of brightness in gradation, displayed as white. During the first reset period r1, as shown in FIG. 5B, the potential Vdd (+10V) is applied as the common potential Vcom, and the potential Vc (+5V) is applied to the pixel electrode. In this period, there is hardly any change in the distribution of the black or white particles, and white is displayed as a reset operation. During the second reset period r2, as shown in FIG. 5C, the potential Vc (+5V) is applied as the common potential Vcom, and the reset potential $V_{RH}$ (+7.5V) is applied to the pixel electrode. In this period, the particles are pulled, the white ones to the common electrode, and the black ones to the pixel electrode. However, since the voltages applied are not particularly high, both kinds of particles are appropriately mixed in terms of distribution, and intermediate gradation display is performed as a reset operation. Thereafter, in the next screen, as shown in FIG. 5D, the potential Vc (+5V) is applied as the common potential Vcom, and the potential $V_{DH}$ (Vdd in this example) is applied to the pixel electrode. Hence, the particles are pulled, the white ones to the pixel electrode, and the black ones to the common electrode, thereby the pixel (1,1) is at approximately the lowest level of brightness in gradation, displayed as black. Performing the reset operation in the intermediate gradation display in advance allows each of the electrophoretic particles to be more mobile; thus, a display in black with an appropriate gradation, without the display contents of the previous screen, is attained.

Figure 6A:
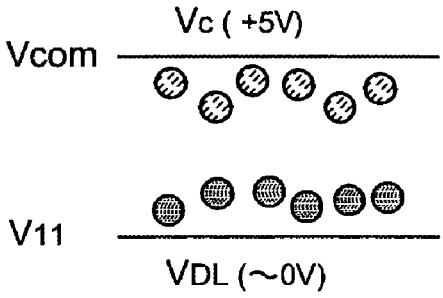
FIGS. 6A through 6D are drawings that schematically describe the behavior of electrophoretic elements.
Figure 6B:
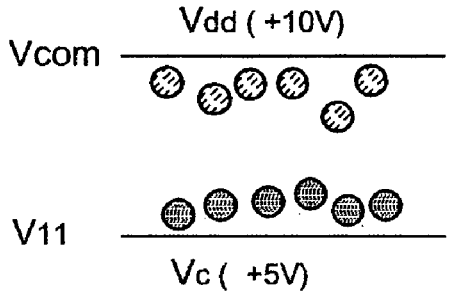
Figure 6C:
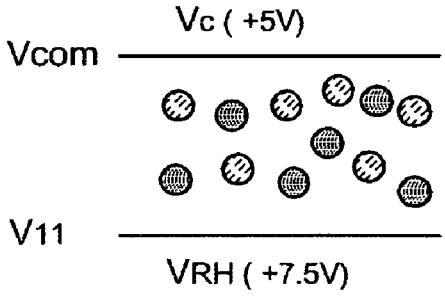
Figure 6D:
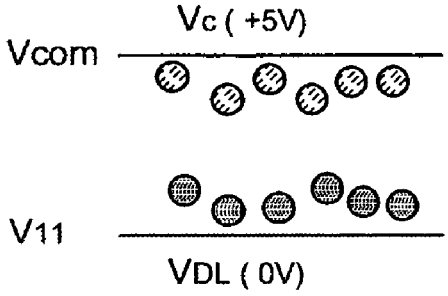

FIGS. 6A through 6D schematically show the behavior of the electrophoretic particles, in a pixel (1,2) where both the data line signal X1 and the scanning line signal Y2 are supplied, and in the case where the previous screen as well as the next screen are displayed as white. In the previous screen, as shown in FIG. 6A, the potential Vc (+5V) is applied as the common potential Vcom to the common electrode, and the potential $V_{DL}$ (approximately 0V) is applied to the pixel electrode. Hence, the particles are pulled, the white ones to the common electrode (upper electrode), and the black ones to the pixel electrode (lower electrode), thereby the pixel (1,2) is at approximately the highest level of brightness in gradation, displayed as white. During the first reset period r1, as shown in FIG. 6B, the potential Vdd (+10V) is applied as the common potential Vcom, and the potential Vc (+5V) is applied to the pixel electrode. In this period, there is hardly any change in the distribution of the black or white particles, and white is displayed as a reset operation. During the second reset period r2, as shown in FIG. 6C, the potential Vc (+5V) is applied as the common potential Vcom, and the reset potential $V_{RH}$ (+7.5V) is applied to the pixel electrode. In this period, the particles are pulled, the white ones to the common electrode, and the black ones to. the pixel electrode. However, since the voltages applied are not particularly high, both kinds of particles are appropriately mixed in terms of distribution, and intermediate gradation display is performed as a reset operation. Thereafter, in the next screen, as shown in FIG. 6D, the potential Vc (+5V) is applied as the common potential Vcom, and the potential $V_{DL}$ (VSS in this example) is applied to the pixel electrode. Hence, the particles are pulled, the white ones to the common electrode, and the black ones to the pixel electrode, thereby the pixel (1,2) is at approximately the highest level of brightness in gradation, displayed as white. Performing the reset operation in the intermediate gradation display in advance allows each of the electrophoretic particles to be more mobile; thus, a display in white with an appropriate gradation, without the display contents of the previous screen, is attained.

Figure 7A:
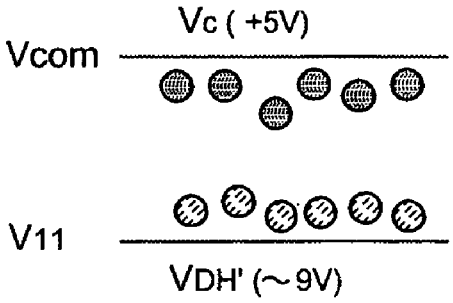
FIGS. 7A through 7D are drawings that schematically describe the behavior of electrophoretic elements.
Figure 7B:
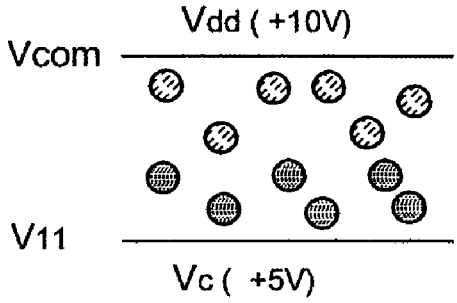
Figure 7C:
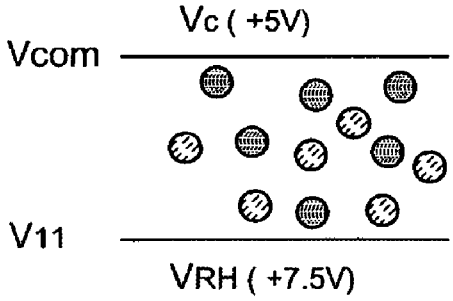
Figure 7D:
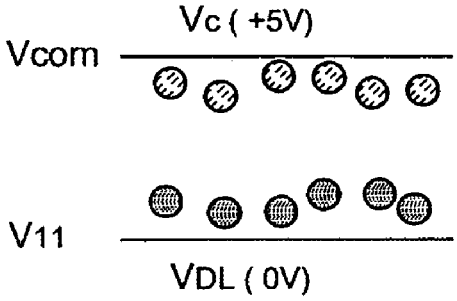

FIGS. 7A through 7D schematically show the behavior of the electrophoretic particles, in a pixel (2,1) where both the data line signal X2 and the scanning line signal Y1 are supplied, and in the case where the previous screen is displayed as black, and the next screen is displayed as white. In the previous screen, as shown in FIG. 7A, the potential Vc (+5V) is applied as the common potential Vcom to the common electrode, and the potential $V_{DH}'$ (in this example, it should be Vdd, but due to the leakage effect, it falls to approximately +9V) is applied to the pixel electrode. Hence, the particles are pulled, the white ones to the common electrode (upper electrode), and the black ones to the pixel electrode (lower electrode), thereby the pixel (2,1) is at approximately the lowest level of brightness in gradation, displayed as black. During the first reset period r1, as shown in FIG. 7B, the potential Vdd (+10V) is applied as the common potential Vcom, and the potential Vc (+5V) is applied to the pixel electrode. In this period, the white particles and the black particles are respectively pulled to the common electrode and to the pixel electrode, and white is displayed as a reset operation. However, in this example, the electrophoretic particles migrate insufficiently; therefore the highest level of brightness in gradation is not achieved. During the second reset period r2, as shown in FIG. 7C, the potential Vc (+5V) is applied as the common potential Vcom, and the reset potential $V_{RH}$ (+7.5V) is applied to the pixel electrode. In this period, the particles are pulled, the white ones to the common electrode, and the black ones to the pixel electrode. However, since the voltages applied are not particularly high, both kinds of particles are appropriately mixed in terms of distribution, and intermediate gradation display is performed as a reset operation. Thereafter, in the next screen, as shown in FIG. 7D, the potential Vc (+5V) is applied as the common potential Vcom, and the potential $V_{DL}$ (Vss =0V in this example) is applied to the pixel electrode. Hence, the particles are pulled, the white ones to the common electrode, and the black ones to the pixel electrode, thereby the pixel (2,1) is at approximately the highest level of brightness in gradation, displayed as white. Performing the reset operation in the intermediate gradation display in advance allows each of the electrophoretic. particles to be more mobile; thus, a display in white with an appropriate gradation, without the display contents of the previous screen, is attained.

Figure 8A:
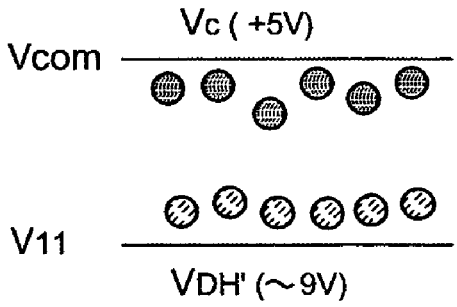
FIGS. 8A through 8D are drawings that schematically describe the behavior of electrophoretic elements.
Figure 8B:
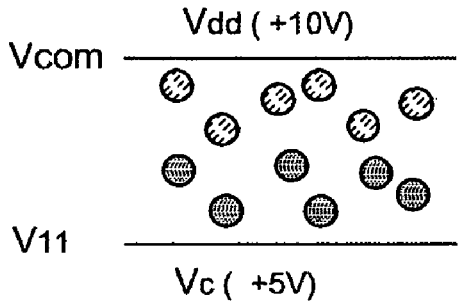
Figure 8C:
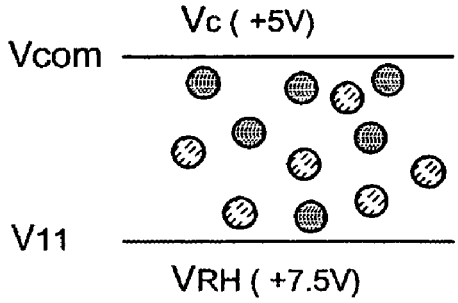
Figure 8D:
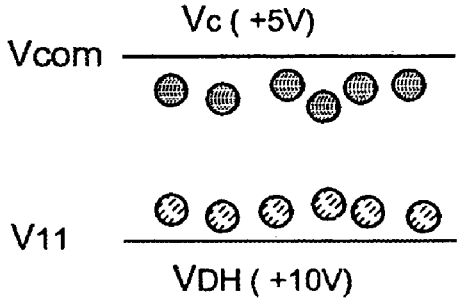

FIGS. 8A through 8D schematically show the behavior of the electrophoretic particles, in a pixel (2,2) where both the data line signal X2 and the scanning line signal Y2 are supplied, and in the case where the previous screen as well as the next screen are displayed as black. In the previous screen, as shown in FIG. 8A, the potential Vc (+5V) is applied as the common potential Vcom to the common electrode, and the potential $V_{DH}'$ (in this example, it should be Vdd, but due to the leakage effect, it falls to approximately +9V) is applied to the pixel electrode. Hence, the particles are pulled, the white ones to the common electrode (upper electrode), and the black ones to the pixel electrode (lower electrode), thereby the pixel (2,2) is at approximately the lowest level of brightness in gradation, displayed as black. During the first reset period r1, as shown in FIG. 8B, the potential Vdd (+10V) is applied as the common potential Vcom, and the potential Vc (+5V) is applied to the pixel electrode. In this period, the white particles and the black particles are respectively pulled to the common electrode and to the pixel electrode, and white is displayed as a reset operation. However, in this example, the electrophoretic particles migrate insufficiently; therefore the highest level of brightness in gradation is not achieved. During the second reset period r2, as shown in FIG. 8C, the potential Vc (+5V) is applied as the common potential Vcom, and the reset potential $V_{RH}$ (+7.5V) is applied to the pixel electrode. In this period, the particles are pulled, the white ones to the common electrode, and the black ones to the pixel electrode. However, since the voltages applied are not particularly high, both kinds of particles are appropriately mixed in terms of distribution, and intermediate gradation display is performed as a reset operation. Thereafter, in the next screen, as shown in FIG. 8D, the electric potential Vc (+5V) is applied as the common potential Vcom, and the electric potential $V_{DH}$ (Vdd=+10V in this example) is applied to the pixel electrode. Hence, the particles are pulled, the white ones to the pixel electrode, and the black ones to the common electrode, thereby the pixel (2,2) is at approximately the lowest level of brightness in gradation, displayed as black. Performing the reset operation in the intermediate gradation display in advance allows each of the electrophoretic particles to be more mobile; thus, a display in black with appropriate gradation, and not with the display contents of the previous screen, is attained.

As described, according to the embodiment, performing the second reset operation, of which the gradation is equivalent to the intermediate gradation, during the first reset period. after the first reset operation, allows the electrophoretic particles to be more mobile. Consequently, each electrophoretic particle can be controlled, independently from the display contents (gradations) of the previous and next screen, hence it is in an appropriate distribution status. As a result, the expression of each pixel's gradation is apt, and the image quality can be improved.

Hereafter, an example of an electronic apparatus that is provided with an electrophoretic display device according to the embodiment is described.

Figure 9A:
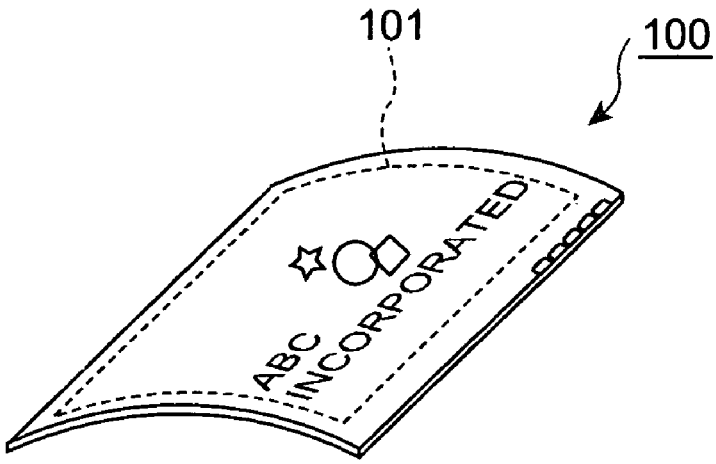
FIGS. 9A and 9B are oblique drawings that describe an example of an electronic apparatus that is provided with the electrophoretic display device.
Figure 9B:
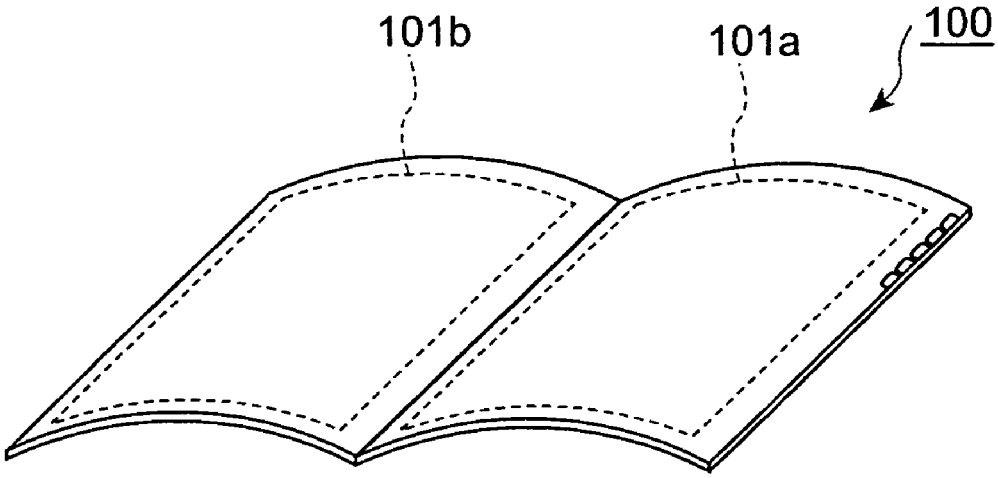

FIGS. 9A and 9B are oblique drawings that describe an example of an electronic apparatus that is provided with an electrophoretic display device. As an example of the electronic apparatus, a so-called electronic paper is illustrated. As shown in FIG. 9A, an electronic paper 100 according to the invention is provided with the aforementioned electrophoretic display device 1 as a display unit 101. FIG. 9B is an example of configuring the electronic paper 110 when it is folded in two, where each side is provided with the electrophoretic display device 1 as display units 101*a* or 101*b*. Besides the illustrated electronic paper, the electrophoretic display device 1 can be applied to various electronic apparatuses provided with display units (or example, integrated circuit cards, personal digital assistance, and electronic notebooks, etc.).

The present invention shall not be limited to the content of the present embodiments described above, and within the main scope of the present invention, it is possible to embody the present invention with other kinds of modifications.

For instance, while in the above-referenced embodiment, an example of the case of conducting a white reset in the first reset period has been described, the invention can also be embodied in the case of displaying all the pixels as black in the first reset period (a so-called black reset).

Figures 10A, 10B, 10C:
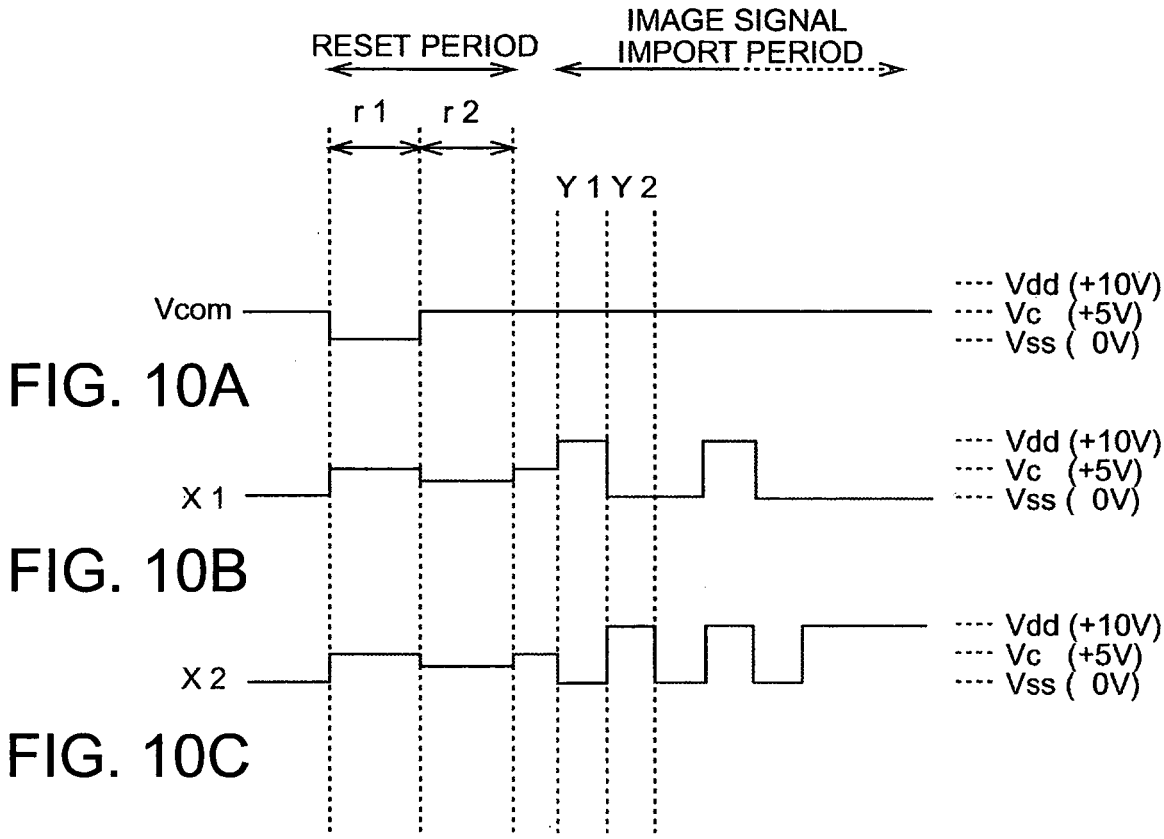
FIGS. 10A through 10C are wave pattern diagrams that describe the method for driving each electrophoretic element, in the case of conducting a black reset in a first reset period.

FIGS. 10A through 10C are wave pattern diagrams that describe the method for driving each electrophoretic element, in the case of conducting the black reset in the first reset period. The description is omitted for the part that overlaps with the aforementioned embodiment. In the driving method shown in FIGS. 10A through 10C, during the first reset period r1, a voltage equivalent to the first gradation, which has a lower level of brightness than the intermediate gradation, is applied between the common electrode and the pixel electrode, thereby moving the electrophoretic particles. Further, during the second reset period r2, a voltage, which is equivalent to the third gradation located in between the first gradation and the second gradation, is applied between the common electrode and the pixel electrode, thereby moving the electrophoretic particles.

In the example shown in FIGS. 10A through 10C, all the pixels are reset to the lowest gradation in the first reset period r1, by applying a voltage-equivalent of the lowest level of brightness (in other words, the strongest black) as the voltage-equivalent of the first gradation. Further, all the pixels are reset to the intermediate gradation in the second reset period r2, by applying a voltage-equivalent of the level of brightness lower than that of the second gradation and higher than that of the intermediate gradation, as the voltage-equivalent of the third gradation. More specifically, the voltage equivalent to the first gradation in the first reset period is attained by applying a low power source potential Vss (for instance, 0V) to the common electrode, while also applying the common potential Vc (for instance, +5V), which is higher than the Vss, to the pixel electrode. Here, the relative potential of the common electrode, when compared to a reference point of pixel electrode, is Vss−Vc. In this embodiment, the relation of potentials is configured to be Vss<Vc<Vdd, hence Vdd−Vc is a negative potential, and particles charged with positive potential (for example, the black particles) are pulled to the common electrode. Moreover, the voltage equivalent to the third gradation in the second reset period is attained by applying the common potential Vc (for instance, +5V) to the common electrode, while also applying a reset potential $V_{RL}$, which is lower than the common potential Vc and higher than the low power source potential Vss, or, in other words, a potential that fulfills the relationship Vss<$V_{RL}$<Vc (for instance, +2.5V), to the pixel electrode. Here, the relative potential of the common electrode, when compared to a reference point of the pixel electrode, is expressed with Vc−$V_{RL}$, which is a positive potential fulfilling the relationship Vss<$V_{RL}$<Vc, and particles charged with negative potential (for example, the white particles) are pulled to the common electrode.

During the image signal import period, an image write-in is conducted by applying the common potential Vc to the common electrode, while applying either the potential $V_{DH}$ ($V_{DH}$>Vc), relatively positive when compared to a reference point of the common potential Vc, or the relatively negative potential $V_{DL}$($V_{DL}$<Vc), to the pixel electrode. This common potential Vc can easily be generated by setting it to an intermediate potential lower than the high power source potential Vdd and higher than the low power source potential Vss, which can be expressed as (Vdd+Vss)/2(=+5V), where Vdd is +10V and Vss is 0V for instance.

The description of the behavior of the electrophoretic particles driven by the driving method shown in FIGS. 10A through 10C is omitted, since it largely overlaps with the description for FIGS. 5A, . . . 5D through 8A, . . . 8D. Similar to the previously mentioned embodiment, in the driving method according to the current example, performing the second reset operation, of which the gradation is equivalent to the intermediate gradation, during the first reset period after the black reset operation, allows the electrophoretic particles to be more mobile. Consequently, each electrophoretic particle can be controlled, independently from the display contents (gradations) of the previous and next screen, hence it is in an appropriate distribution status. As a result, the expression of each pixel's gradation is apt, and the image quality can be improved.

In the previously mentioned embodiment, the electrophoretic element, with a structure in which the pixel electrode and the common electrode are arranged having an a space between them in the top-down direction, is illustrated. However, the electrophoretic element, with a structure in which the pixel electrode and the common electrode are arranged having a space between them in the left-to-right (lateral) direction (a so-called in-plane type), may also be employed.

Figure 11A:
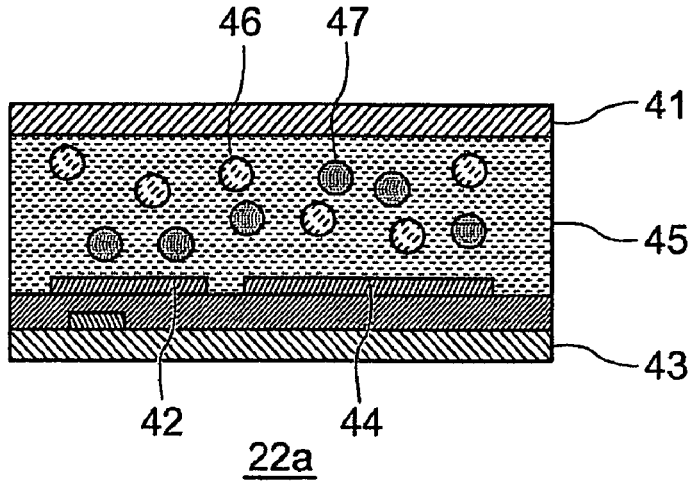
FIGS. 11A and 11B are drawings that describe example structures of in-plane electrophoretic elements.
Figure 11B:
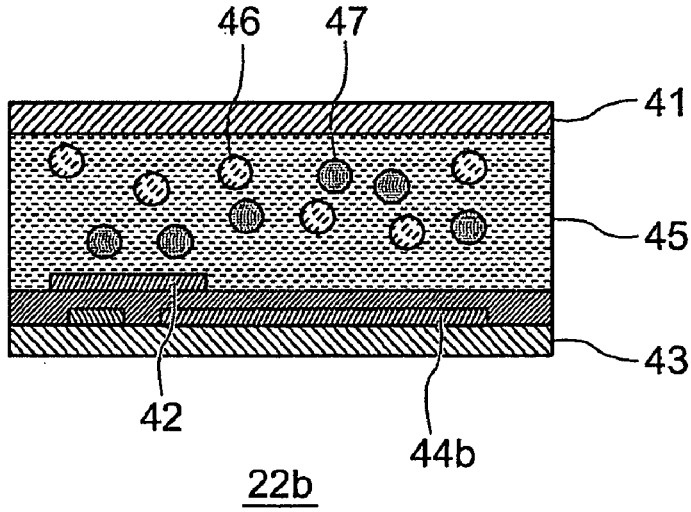
Figure 12:
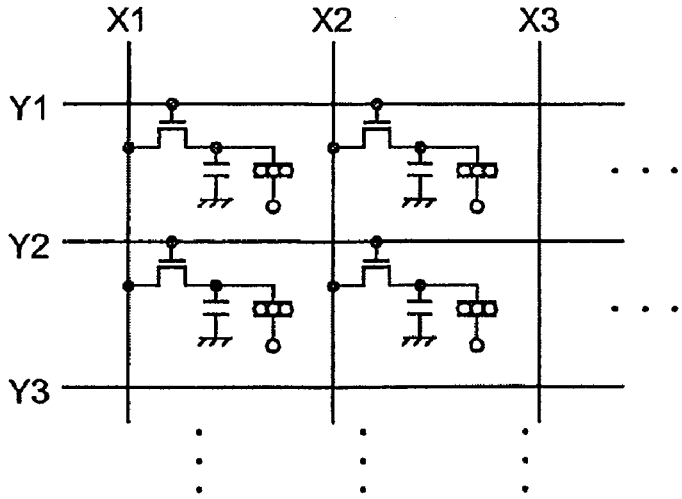
FIG. 12 PRIOR ART
FIG. 12 is a diagram that describes an example structure of circuitry for active-matrix electrophoretic devices.
Figures 17A, 17B, 17C:
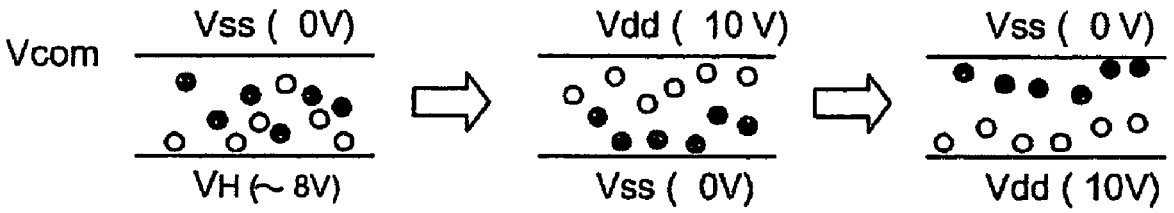
FIG. 17A PRIOR ART
FIG. 17B PRIOR ART
FIG. 17C PRIOR ART
FIGS. 17A through 17C are drawings that schematically describe the behavior of electrophoretic particles in a spatial distribution, driven with the common driving method shown in FIGS. 13A through 13C.

FIGS. 11A and 11B are drawings that describe example structures of in-plane electrophoretic elements. In an electrophoretic element 22*a* shown in FIG. 11A, a dispersal system 45, which includes electrophoretic particles 46 and 47, is laid between substrates 41 and 43. By applying a voltage between a pixel electrode 42 and a common electrode 44, both of which are provided on the side of the substrate 43, electrophoretic particles 46 and 47 migrate, hence a display is conducted. Moreover, an electrophoretic element 22*b* as shown in FIG. 11B basically has a similar structure as that of the electrophoretic element 22*a* as shown in FIG. 11A. The difference is that the pixel electrode 42 and the common electrode 44 are not arranged on the same plane, but instead overlapping with each other. The invention may be applied also to the electrophoretic display device that employs the electrophoretic element with aforementioned structures.

In the above-mentioned embodiments, the case, where the dispersal system that includes two kinds of electrophoretic particles (two-particle system), each kind of particles being respectively charged to positive or negative potential, is employed, is explained as an example. However, the invention may also be similarly applied to the case of single-particle system that includes a single kind of electrophoretic particles charged either to the positive or negative potential.

Further, in the above-mentioned embodiments, the dispersal system that includes particles of white and black colors is illustrated; however, the colors that each electrophoretic particle has are not limited to the two colors mentioned above, and can be selected at will.

The entire disclosure of Japanese Patent Application No. 2004-381485, filed Dec. 28, 2004 is expressly incorporated by reference herein.

What is claimed is:

1. A method for driving an electrophoretic device, including: an electrophoretic element, in which a dispersal system that includes electrophoretic particles is laid between a common electrode and a pixel electrode; a driving circuit for driving the electrophoretic element by applying a voltage between the common electrode and the pixel electrode; and a controller for controlling the driving circuit; the method comprising:

an image rewrite period process for controlling the driving circuit by the controller, and applying a voltage on the common electrode and the pixel electrode, thereby conducting an image rewrite, the image rewrite period process including a reset period and an image signal import period that follows the reset period;

wherein the reset period includes:

a first reset period process, during which a first voltage is applied between the common electrode and the pixel electrode, thereby causing the electrophoretic particles to migrate; and a second reset period process, during which a second voltage is applied between the common electrode and the pixel electrode, the second voltage having an opposite polarity to the first voltage, thereby causing the electrophoretic particles to migrate, wherein an absolute value of the second voltage is less than an absolute value of the first voltage.

2. The method for driving the electrophoretic device, according to claim 1, wherein:

the first voltage in the first reset period is achieved by applying a high power source potential Vdd to the common electrode, while also applying a common potential Vc, which is lower than the high power source potential Vdd, to the pixel electrode; and the second voltage in the second reset period is achieved by applying the common potential Vc to the common electrode, while also applying a reset potential $V_{RH}$, which is higher than the common potential Vc and lower than the high power source potential Vdd, to the pixel electrode.

3. The method for driving the electrophoretic device, according to claim 1, wherein during the image signal import period, an image write-in is conducted, by applying the prescribed common potential Vc to the common electrode, while also applying any one of a relatively positive or negative potential based on the common potential Vc to the pixel electrode.

4. The method for driving the electrophoretic device, according to claim 3, wherein the common potential Vc is set to be a potential lower than the high power source potential Vdd, and higher than a low power source potential Vss, and the potential applied to the pixel electrode is set to be any one of $V_{DH}$ or $V_{DL}$, expressed as $V_{DH}>Vc$ and $V_{DL}<Vc$.

5. The method for driving the electrophoretic device, according to claim 3, wherein the common potential Vc is set to an intermediate potential which is between the high power source potential Vdd and the low power source potential Vss, expressed as (Vdd+Vss)/2.

6. The method for driving the electrophoretic device, according to claim 1, wherein the electrophoretic device further including a holding capacitor in which one electrode is connected to the common electrode and the other electrode is connected to the pixel electrode.

7. The method for driving the electrophoretic device, according to claim 1, wherein the first voltage corresponds to a highest level of brightness.

8. The method for driving the electrophoretic device, according to claim 1, wherein the first voltage corresponds to a lowest level of brightness.

9. The method for driving the electrophoretic device, according to claim 1, wherein the dispersal system includes positively-charged electrophoretic particles and negatively-charged electrophoretic particles, wherein during the first reset period process, by applying the first voltage, the positively-charged electrophoretic particles are pulled to one of the common electrode and the pixel electrode, and the negatively-charged electrophoretic particles are pulled to the other of the common electrode and the pixel electrode, and wherein during the second reset period process, by applying the second voltage, the positively-charged electrophoretic particles and the negatively-charged electrophoretic particles are distributed in the more mixed condition than a condition during the first reset period process.

10. The method for driving the electrophoretic device, according to claim 1, wherein electric potentials applied to the common electrode and the pixel electrode during the first reset period process and the second reset period process are greater than or equal to zero.

11. An electrophoretic device, comprising:

an electrophoretic element, in which a dispersal system that includes electrophoretic particles is laid between a common electrode and a pixel electrode;

a driving circuit for driving the electrophoretic element by applying a voltage between the common electrode and the pixel electrode; and a controller for controlling the driving circuit, wherein the controller executes an image rewrite period, during which the driving circuit applies a voltage to the common electrode and to the pixel electrode in order to conduct an image rewrite, the image rewrite period including a reset period and an image signal import period following the reset period, wherein the reset period includes:

a first reset period, during which a first voltage is applied between the common electrode and the pixel electrode, thereby causing the electrophoretic particles to migrate; and a second reset period, during which a second voltage is applied between the common electrode and the pixel electrode, the second voltage having an opposite polarity to the first voltage thereby causing the electrophoretic particles to migrate, wherein an absolute value of the second voltage is less than an absolute value of the first voltage.

12. The electrophoretic device according to claim 11, wherein the controller achieves:

the first voltage in the first reset period, by applying a high power source potential Vdd to the common electrode, while also applying a common potential Vc, which is lower than the high power source potential Vdd, to the pixel electrode; and the second voltage in the second reset period, by applying the common potential Vc to the common electrode, while also applying a reset potential $V_{RH}$, which is higher than the common potential Vc and lower than the high power source potential Vdd, to the pixel electrode.

13. The electrophoretic device according to claim 11, wherein the controller, during the image signal import period, conducts an image write-in, by applying the prescribed common potential Vc to the common electrode, while also applying any one of a relatively positive or negative potential based on the common potential Vc to the pixel electrode.

14. The electrophoretic device according to claim 13, wherein the controller sets the common potential Vc to be a potential lower than the high power source potential Vdd, and higher than a low power source potential Vss, and sets the potential applied to the pixel electrode to be any one of $V_{DH}$ or $V_{DL}$, expressed as $V_{DH}>Vc$ and $V_{DL}<Vc$.

15. The electrophoretic device according to claim 13, wherein the common potential Vc is set to an intermediate potential which is between the high power source potential Vdd and the low power source potential Vss, expressed as (Vdd+Vss)/2.

16. The electrophoretic device according to claim 11, further comprising a holding capacitor in which one electrode is connected to the common electrode and the other electrode is connected to the pixel electrode.

17. An electronic apparatus provided with the electrophoretic device according to claim 11.

* * * * *